US006461474B1

(12) United States Patent
Lindsay et al.

(10) Patent No.: US 6,461,474 B1
(45) **Date of Patent: *Oct. 8, 2002**

(54) PROCESS FOR PRODUCING HIGH-BULK TISSUE WEBS USING NONWOVEN SUBSTRATES

(75) Inventors: Jeffrey Dean Lindsay, Appleton, WI (US); Mark Alan Burazin, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 175 days.

This patent is subject to a terminal disclaimer.

(21) Appl. No.: 09/613,918

(22) Filed: Jul. 11, 2000

Related U.S. Application Data

(63) Continuation of application No. 09/090,110, filed on Jun. 3, 1998, now Pat. No. 6,120,642, which is a continuation of application No. 08/709,427, filed on Sep. 6, 1996, now abandoned.

(51) Int. Cl.[7] ..... D21F 11/00
(52) U.S. Cl. ..... 162/109; 162/117
(58) Field of Search ..... 162/109, 116, 162/117, 113, 1

(56) References Cited

U.S. PATENT DOCUMENTS

| | | | |
|---|---|---|---|
| 1,536,533 | A | 5/1925 | Sheehan |
| 2,038,712 | A | 4/1936 | Brodin |
| 3,059,312 | A | 10/1962 | Jamieson |
| 3,309,263 | A | 3/1967 | Grobe |
| 3,399,111 | A | 8/1968 | Beaumont et al. |
| 3,617,442 | A | 11/1971 | Hurschman |
| 4,072,557 | A | 2/1978 | Schiel |
| 4,440,597 | A | 4/1984 | Wells et al. |
| 4,529,480 | A | 7/1985 | Trokhan |
| 4,541,895 | A | 9/1985 | Albert |
| 4,569,883 | A | 2/1986 | Renjilian |
| 4,849,054 | A | 7/1989 | Klowak |
| 5,048,589 | A | 9/1991 | Cook et al. |
| 5,069,548 | A | 12/1991 | Boehnlein |
| 5,192,290 | A | 3/1993 | Hilal |
| 5,230,371 | A | 7/1993 | Lee |

(List continued on next page.)

FOREIGN PATENT DOCUMENTS

| | | |
|---|---|---|
| CA | 873 651 | 6/1971 |
| EP | 0 140 404 A1 | 5/1985 |
| EP | 0 677 612 A2 | 10/1995 |
| GB | 2 254 288 B | 10/1992 |
| GB | 2 279 372 A | 1/1995 |

OTHER PUBLICATIONS

Adanur, Sabit, *Paper Machine Clothing*, Technomic Publishing Co., Inc., Lancaster, PA, 1997, Section 4.2, pp. 194–195, and Section 4.6.2, pp. 244–250.

Bieman, Leonard H., Absolute Measurement Using Field Shifted Moire, SPIE vol. 1614, *Optics, Illumination, and Image Sensing for Machine Vision VI*, Nov. 14–15, 1991, pp. 259–264.

Race, E., J.B. Wheeldon, and T.N. Ashworth, "The Scapa Pocket Ventilator For Use With Open–Mesh Fabrics And Highly Permeable Felts," *Pulp And Paper Magazine Of Canada*, 68(2), Feb. 1967, pp. 66–70.

*Primary Examiner*—Peter Chin
(74) *Attorney, Agent, or Firm*—Gregory E. Croft

(57) ABSTRACT

The invention relates to a papermaking fabric and method of producing a soft, bulky tissue web in which an embryonic fiber web is wet-molded onto a three-dimensional substrate wherein the web-contacting surface of said substrate is a three-dimensional porous nonwoven material. The method can provide higher levels of bulk and surface depth in tissues than is practical with woven papermaking fabrics.

8 Claims, 1 Drawing Sheet

U.S. PATENT DOCUMENTS

| | | | | | |
|---|---|---|---|---|---|
| 5,330,604 | A | | 7/1994 | Allum et al. | |
| 5,348,620 | A | | 9/1994 | Hermans et al. | |
| 5,364,504 | A | | 11/1994 | Smurkoski et al. | |
| 5,366,785 | A | | 11/1994 | Sawdai | |
| 5,366,786 | A | | 11/1994 | Connor et al. | |
| 5,393,831 | A | | 2/1995 | Hudson | |
| 5,429,686 | A | | 7/1995 | Chiu et al. | |
| 5,454,405 | A | | 10/1995 | Hawes | |
| 5,482,772 | A | | 1/1996 | Strack et al. | |
| 5,501,768 | A | | 3/1996 | Hermans et al. | |
| 5,508,095 | A | | 4/1996 | Allum et al. | |
| 5,510,002 | A | | 4/1996 | Hermans et al. | |
| 5,512,319 | A | | 4/1996 | Cook et al. | |
| 5,514,523 | A | * | 5/1996 | Trokhan et al. | 162/117 |
| 5,549,790 | A | * | 8/1996 | Van Phan | 162/109 |
| 5,593,545 | A | | 1/1997 | Rugowski et al. | |
| 5,607,551 | A | | 3/1997 | Farrington, Jr. et al. | |
| 5,667,636 | A | | 9/1997 | Engel et al. | |
| 5,779,965 | A | | 7/1998 | Beuther et al. | |
| 5,814,190 | A | * | 9/1998 | Van Phan | 162/117 |
| 6,080,691 | A | | 6/2000 | Lindsay et al. | |
| 6,120,642 | A | | 9/2000 | Lindsay et al. | |

* cited by examiner

PROCESS FOR PRODUCING HIGH-BULK TISSUE WEBS USING NONWOVEN SUBSTRATES

This application is a continuation of Ser. No. 09/090,110 filed on Jun. 3, 1998, now U.S. Pat. No. 6,120,642, which is a continuation of Ser. No. 08/709,427 filed on Sep. 6, 1996, now abandoned.

BACKGROUND OF THE INVENTION

Historically, tissue making has relied on creping technology to provide a paper sheet with adequate softness and bulk. Recently, new methods have been developed for uncreped tissue manufacture with noncompressive drying methods, especially through-air drying, to achieve soft, high bulk, wet resilient structures with novel properties. For practical reasons, these methods utilize woven papermaking fabrics to provide the three-dimensional structure required in uncreped sheets if they are to have excellent mechanical properties such as high bulk, high stretch in the cross direction, and high compressive wet resiliency.

Unfortunately, woven fabrics are limited in terms of height differentials and patterns that can be achieved. There are physical constraints on what can be produced on a loom, and there are further constraints on the runnability of anything so produced. While high surface depth (characteristic peak to valley depth) may be desired in many cases in order to impart bulk, stretch, and texture to a paper web, only a narrow range of surface depths can be achieved practically in existing papermaking fabrics. Further, the surface topography of woven papermaking structures are inherently characterized by precipitous peaks and valleys with step changes in height that are typically some multiple of a filament diameter. Typically, the surface has a series of warps or chutes elevated relative to other filaments, with multiple interstices between the filaments. A probe passing along such a surface will encounter a series of sudden jumps up and down. A papermaking web deformed against such a surface becomes smoothed by the physics of paper deformation, but if the underlying fabric surface is given a high degree of surface depth, the large, precipitous peaks and valleys in the fabric can result in sharp structures in the paper web which can be perceived as grits or abrasive elements by humans using the product, especially if the sheet remains uncreped. Much more desirable would be a substrate for forming paper that could have a high degree of surface depth without precipitous peaks and valleys, but rather less abrupt structures offering more pillow-like topography against which the paper web could be deformed.

A further problem with typical woven structures for papermaking is that the filaments and the surface structure itself are largely incompressible. As a result, highly textured 3-D structures are problematic in operations where one surface contacts another, as in a pressing event or a sheet transfer between two fabrics, because most of the load, shear stress, or friction during the event is borne by a small portion of the web resting on or near the highest filaments, which can result in breaking of the web near the high spots of the substrate or other forms of damage to the web and even to the underlying substrate. In some cases, it would be desirable if the highest elements in a 3-D substrate were deformable to allow the 3-D substrate to perform better in a nip or sheet transfer point such that the integrity of the web is better maintained or the distribution of stress is more uniform as the substrate deforms. This is particularly important when the transfer or pressing event involves a first textured substrate such as a papermaking fabric and a second textured substrate such as a fabric or patterned roll, for damage to the sheet and the textured substrates can occur at contact points involving relatively high spots from both substrates unless one or both such substrates can deform to allow more uniform load or stress distributions to be established.

The use of nonwoven substrates in the formation or drying of paper is known to a limited degree, for monoplanar films and membranes have been taught for the production of tissue. In tissue making, these structures typically offer flat, planar regions for imprinting a web during a compression step in order to provide a network of densified regions surrounding undensified regions, with the densified regions providing strength and the undensified regions providing softness and absorbency. Such structures and processes lack the contoured, non-planar three-dimensionality most desirable for textured and noncompressively dried materials and, due to the lack of a non-monoplanar, 3-D wet molding surface, are incapable of providing the high bulk levels of the present invention. Such processes also result in a sheet with regions of high density and regions of low density, unlike the structures of substantially uniform density provided in the noncompressive drying method of the present invention. Further, substantially planar films are inherently limited in their ability to impart three-dimensional structures to a sheet.

Therefore, it would be desirable to provide a method for improving the degree of wet molding and surface depth that can be achieved in a soft, noncompressively dried tissue.

SUMMARY OF THE INVENTION

It has been discovered that three-dimensional nonwoven structures can be used as the substrate for wet molding or through drying a tissue web, thus greatly increasing the possible geometries and textures that can be applied to the web. The use of three-dimensional nonwoven substrates for wet molding allows higher sheet bulk and higher surface depth to be achieved than is possible even with advanced woven substrates. Further, it has been discovered that a tissue web can be given high bulk and distinct three-dimensional texture by the proper application of differential velocity transfer from a carrier fabric onto an endless belt comprising a three-dimensional nonwoven surface, followed by or simultaneous with a proper air pressure differential across the web and substrate to further control the molding of the sheet. The web can also have high wet resiliency properties if the molding of the sheet occurs while the sheet is still relatively moist, followed by substantially noncompressive drying said web on the molding substrate to a solids level of about 70% or more.

In one embodiment, the nonwoven surface has sufficient compressive compliance to deform substantially in a nip or during sheet transfer, in order to prevent damage to a weak, wet sheet as it is suddenly applied to a highly textured surface. A compliant surface may also be useful in other compressive transfers as in the transfer nip of a can dryer or during other events. Preferably, the nonwoven surface is structured to provide pillow-like contours rather than the sharp, precipitous peaks and valleys that are typical of three-dimensional woven structures, for such precipitous structures often give rise to grittiness in the final product. In a further embodiment, the nonwoven material is extruded onto an existing porous underlayment in a manner that disguises or fills in undesirable structures of the underlayment while providing additional desired structures, allowing the underlayment to be selected for strength, runnability, or other characteristics independent of the topography of the underlayment. Such underlayments can include materials other than traditional papermaking fabrics and can include porous substrates such fabrics, felts, general textiles, reticulated foams, metallic screens, dense extruded plastics and nonwovens, laminated composites, and multicomponent woven and nonwoven structures.

Hence in one aspect, the invention resides in a method for making a high bulk paper sheet comprising:

(a) forming an embryonic web from an aqueous dispersion of papermaking fibers, preferably on a papermaking forming fabric;

(b) transferring the web from the papermaking forming fabric to a wet molding substrate comprising an upper porous nonwoven member and an underlying porous member supporting said upper porous nonwoven member, with the upper nonwoven member defining the paper-contacting surface of said wet molding substrate, preferably wherein (1) the upper porous nonwoven member comprises a fibrous or foam-based material having a Low Pressure Compressive Compliance (hereinafter defined) greater than 0.05, preferably greater than 0.1; a High Pressure Compressive Compliance (hereinafter defined) greater than 0.05, preferably greater than 0.1; and an Upper Surface Depth (hereinafter defined) of at least 0.1 mm, preferably at least 0.5 mm, more preferably at least 1.0 mm, more preferably still at least 1.5 mm, and most preferably between 0.8 and 2.0 mm; and (2) the permeability of said wet molding substrate is sufficient to permit an air pressure differential across the wet molding substrate to effectively mold said web onto said upper porous nonwoven member to impart a three-dimensional structure to said web; and (3) the velocity of the web is reduced during the transfer to the wet molding substrate by at least 8%; desirably up to 80%, preferably 8 to 80%, more preferably 8 to 60%, more preferably still between about 10 to 60%; and most preferably between about 15 to 50%; and (4) the transfer to the wet molding substrate occurs at a solids level in said web below about 40%; preferably below 30%, more preferably below 28%; more preferably still below about 25%; and suitably between 10 and 30%;

(c) applying an air pressure differential across said web to further mold said web against said upper porous nonwoven member;

(d) noncompressively drying said web to a dryness level of at least 40%, more specifically at least 50%, more specifically at least 50%, still more specifically at least about 70%, more specifically at least about 75%, and most specifically between about 70% and 98%.

In one embodiment of the present invention, two stages of wet molding can be desirable, beginning with wet molding directly on the forming fabric, followed by molding onto a separate three-dimensional fabric during non-compressive drying. The interaction of two molding patterns can enhance bulk, visual appeal, and reduce stiffness. Forming on a three-dimensional forming fabric can provide a desirable nonuniform basis weight and density distribution in the sheet, while molding during drying on a separate three-dimensional fabric can impart desirable properties of increased stretch (especially in the cross-direction), reduced stiffness, and increased bulk.

In another embodiment, web transfers to additional intermediate fabrics before the transfer to the wet molding substrate can be done, preferably with rush transfer. Additional rush transfer stages can also be performed after the transfer to the wet molding substrate.

The basis weight of the webs of this invention can be about 8 grams per square meter (gsm) or greater, more specifically from about 10 to about 80 gsm, still more specifically from about 20 to about 60 gsm, and still more specifically from about 30 to about 50 gsm.

Any suitable papermaking fibers can be used, including those produced by kraft pulping, sulfite pulping, mechanical pulping, including TMP, CTMP, and groundwood, and so forth. Both virgin and recycled fibers may be used. In addition to wood-based fiber sources, other fibers may be used such as those derived from cotton, kenaf, bagasse, hemp, milkweed, abaca, and the like. The fiber composition of the webs of this invention preferably have from about 10 to 100 percent wood pulp fibers, particularly containing about 70 percent or greater, more specifically about 80 percent or greater, more specifically about 90 percent or greater, and still more specifically about 95 percent wood pulp fibers or greater. Additionally, it is preferred that the fiber composition of the webs of this invention comprise about 70 percent or greater softwood fibers, more specifically about 80 percent or greater, and still more specifically about 90 percent or greater softwood fibers. The fiber furnish may include wet strength and dry strength additives, retention aids, starch, chemical softeners, and other chemical additives and fillers known in the art.

It is preferred that rush transfer be used in placing the web on the nonwoven wet molding substrate. The wet molding substrate should be traveling more slowly than the carrier fabric (the fabric from which the web is transferred) by a factor greater than about 8%, preferably greater than about 10%, more preferably greater than about 20%, more preferably still greater than about 30%, and most preferably greater than 45%, desirably with a range of 10 to 80% more desirably with a range of 20 to 50%. A useful process is that taught by U.S. Pat. No. 5,048,589 entitled "Non-Creped Hand or Wiper Towel", issued Sep. 17, 1991 to Cook et al., hereby incorporated by reference. During rush transfer, the web is transferred from a carrier fabric (for example, a forming fabric) to the wet molding substrate, preferably with the aid of a vacuum transfer shoe such that the carrier fabric and wet molding substrate simultaneously converge and diverge at or near the leading edge of the vacuum slot. A vacuum roll could also be used. Following transfer of the web to the wet molding substrate and prior to noncompressive drying, it may be desirable to pass the wet molding substrate over a vacuum box to further mold the web against the wet molding substrate.

For the creation of a highly wet resilient sheet, at least about 10% high yield papermaking fibers should be used, and preferably at least about 15% high yield papermaking fibers, coupled with wet strength agents sufficient to achieve a sheet having a wet:dry tensile strength ratio of at least 0.1.

For the creation of a soft tissue sheet suitable for use as bath tissue, facial tissue, or a paper towel, the process of wet molding onto a nonwoven material, as described above, can be further modified to include the use of layered forming with hardwood fibers on an outer surface or surfaces of the web, the optional use of temporary wet strength agents, properly dispersed and curled fibers, such as those taught by U.S. Pat. No. 5,348,620 entitled "Method of Treating Papermaking Fibers For Making Tissue", issued Sep. 20, 1994 to Hermans et al. and U.S. Pat. No. 5,501,768 entitled "Method of Treating Papermaking Fibers For Making Tissue", issued Mar. 26, 1996 to Hermans et al., both herein incorporated by reference, the addition of debonding agents, and the like, but coupled with the use of rush transfer onto a wet molding fabric comprising a nonwoven material in contact with the paper web for improved texture, bulk, and other properties. A useful uncreped method of producing soft tissue is described in co-pending U.S. Ser. No. 08/399,277 by Farrington et al. entitled "Soft Tissue", herein incorporated by reference.

The method of the present invention can be capable of producing sheets having a bulk greater than 9 cc/g, preferably greater than 10 cc/g, more preferably greater than 16 cc/g, more preferably still greater than 20 cc/g, and most preferably greater than 25 cc/g.

In another aspect, the invention resides in a papermaking fabric comprising an upper porous nonwoven member and an underlying porous member supporting said upper porous member wherein:

(1) the upper porous nonwoven member comprises a fibrous or foam-based material having a Low Pressure Compressive Compliance (hereinafter defined) greater than 0.05, preferably greater than 0.1; a High Pressure Compressive Compliance (hereinafter defined) greater than 0.05, preferably greater than 0.1; and an Upper Surface Depth (hereinafter defined) of at least 0.1 mm, preferably at least 0.5 mm, more preferably at least 1.0 mm, more preferably still at least 1.5 mm, and most preferably between 0.8 and 2.0 mm; and (2) the permeability of said wet molding substrate is sufficient to permit an air pressure differential across the wet molding substrate to effectively mold said web onto said upper porous nonwoven member to impart a three-dimensional structure to said web.

DETAILED DESCRIPTION OF THE DRAWINGS

Figure 1:
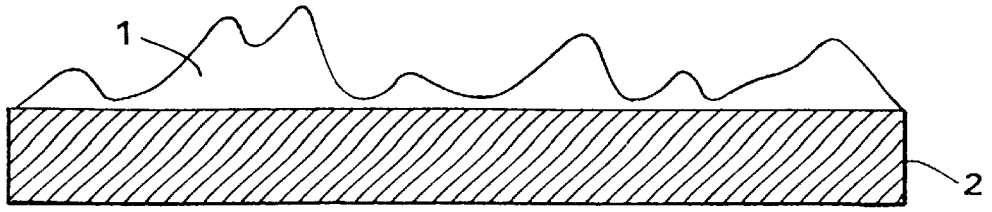
FIG. 1 schematically depicts a cross section of a wet molding substrate useful for the present invention.

The present invention resides in a process for making tissue wherein the fibrous web, prior to complete drying, is molded onto a three-dimensional, contoured (non-monoplanar) substrate comprising at least one layer of a porous synthetic polymeric or ceramic or metallic nonwoven material in contact with the web. A representation of such a substrate is shown in FIG. 1, showing a cross section of a porous nonwoven upper member 1 and an underlying porous member 2 which may be woven, wherein the underlying porous member 2 provides strength and runnability to the substrate while the upper nonwoven layer 1 controls the texture to be imparted to a wet embryonic fibrous web. Each layer of porous nonwoven material in the nonwoven member 1 may be in the form of fibrous mats or webs, such as bonded carded webs, airlaid webs, scrim, needled webs, extruded networks, and the like, or foams, preferably open cell or reticulated foams, as well as extruded foams. including extruded polyurethane foams. Suitable polymers comprise polyester, polyurethane, vinyl, acrylic, polycarbonates, nylon, polyamides, polyethylene, polypropylene, and the like. For fibrous mats, the nonwoven material may be either the synthetic polymers mentioned above or optionally a bulky ceramic material such as fiberglass or fibrous ceramic materials commonly used as filters or insulating material, including alumina or silicate structures produced by Thermal Ceramics, Inc. of Augusta, Ga., in the form of wet laid or air laid fiber mats. Preferably, the nonwoven member is stable to temperatures above 240° F., preferably above 270° F., more preferably above 300° F., more preferably above 350° F., and most preferably above 400° F., in order to ensure a suitable lifetime under intense drying conditions. Commercial polymeric fibers known for temperature resistance include polyesters; aramids such as Nomex fibers, manufactured by DuPont, Inc., and the like. Preferably the nonwoven layer is sufficiently gas permeable throughout the breadth of the substrate that no roughly circular region greater than about 2.5 mm in diameter, preferably greater than about 1.5 mm in diameter, more preferably greater than about 0.9 mm, and most preferably greater than about 0.5 mm will be substantially blocked from air flow under conditions of differential air pressure across the substrate with a pressure differential of 0.1 psi or greater at a temperature of 25° C. Suitable underlying porous members include known papermaking fabrics and felts, especially dryer fabrics, through-drying fabrics, and forming fabrics; reticulated foam structures; metallic meshes or wires; general textiles; porous belts; dense extruded plastics and nonwovens; laminated composites; and multicomponent woven and nonwoven structures. The underlying porous member can also be a nonwoven material such as the nonwoven basecloth claimed in GB 2,254,288 entitled "Papermachine Clothing" issued Nov. 30, 1994 to Buchanan et al. The underlying porous member preferably has sufficient z-direction gas permeability to permit conventional through drying of a wet paper web. The nonwoven material or materials are attached to the underlying porous member, and the entire substrate is preferably formed in an endless belt suitable for papermaking. Attachment of a nonwoven layer to the underlying porous member can be by any means known in the art, including but not limited to lamination, extrusion, attachment with adhesives at specific contact points, melt bonding, entanglement, hydroentanglement, sewing. ultrasonic welding, hot melt adhesives, needling of fibers to interconnect layers, or simply nesting or laying a nonwoven layer onto the underlying papermaking fabric.

The nonwoven layer 1 preferably should be intrinsically gas permeable to permit drying and molding of the paper web onto the nonwoven layer by air flow through the sheet and the nonwoven layer. The layers can be apertured, slit, cut, drilled, pierced, debonded, or needled in the creation of a suitably permeable structure.

The material or materials of the nonwoven layer should have sufficient resilience to maintain a three-dimensional structure under vacuum or pneumatic pressure levels typical of through drying or impingement drying. Preferably, however, the material also has a degree of compressibility to permit deformation during mechanical loading or shear such that highly elevated elements on the surface can deform without causing damage to the wet web during contact with another surface, as occurs during typical web transfer events, pressing events, watermarking, or transfer to a can dryer. While noncompressive drying is important for the present invention, it is recognized that somewhat compressive events may occur prior to drying or during normal sheet handling operations which may have the effect of pressing or shearing a web. During such operations, a sheet on a highly contoured substrate with high surface depth might suffer damage as only a small fraction of the web at the most elevated points might be required to bear the load, shear stress, or friction of the operation. Compressible elements may also help alleviate stress in the sheet during treatment by differential air pressure as stressed regions of the substrate deform and distribute the stress to broader regions.

Low Pressure Compressive Compliance of a nonwoven material can be measured by compressing a substantially planar sample of the material having a basis weight above 50 gsm with a weighted platen of 3-inches in diameter to impart mechanical loads of 0.05 psi and then 0.2 psi, measuring the thickness of the sample while under such compressive loads. Subtracting the ratio of thickness at 0.2 psi to thickness at 0.05 psi from 1 yields the Low Pressure Compressive Compliance, or Low Pressure Compressive Compliance=1−(thickness at 0.2 psi/thickness at 0.05 psi). The Low Pressure Compressive Compliance should be greater than 0.05, preferably greater than 0.1, more preferably greater than 0.2, still more preferably greater than 0.3, and most preferably between 0.2 and 0.5.

High Pressure Compressive Compliance is measured using a pressure range of 0.2 and 2.0 psi in making the determination of compliance, otherwise performed as for Low Pressure Compressive Compliance. In other words, High Pressure Compressive Compliance=1−(thickness at 2.0 psi/thickness at 0.2 psi). The High Pressure Compressive Compliance should be greater than 0.05, preferably greater than 0.15, more preferably greater than 0.25, still more preferably greater than 0.35, and most preferably between 0.1 and about 0.5.

A nonwoven material suitable for the present invention is the polyurethane foam applied to a papermaking fabric as disclosed in U.S. Pat. No. 5,512,319, "Polyurethane Foam Composite," issued on Apr. 30, 1996 to Cook et al., herein incorporated by reference. Also of relevance to the present invention are the related papermaking fabrics by Scapa Corporation, Shreveport, La., sold under the trade name "Spectra." The Spectra fabrics incorporate an extruded polyurethane foam membrane on an underlying woven papermaking fabric or batt. Alternatively, Spectra fabrics may consist entirely of extruded foam material. The sales literature on these composite fabrics shows the foam network to be largely planar with holes or apertures imparted by the extrusion process. However, the manufacturing process could be modified to create a more contoured, three-dimensional surface of varying height more suitable for the present invention.

Indeed, a more useful, related Scapa product are press felts and forming fabrics made with a "Ribbed Spectra" design comprising two polyurethane regions of differing height. These engineered fabrics have the potential to allow a wide range of three-dimensional structures to be achieved in a papermaking fabric. These fabrics are sold for use in pressing and forming, but for the present invention could be adapted for through drying. The technology may be limited to producing several discrete planar regions which differ in height. While such a surface is not preferred for imparting desirable texture to the paper web, preferable results can be obtained by creating more three-dimensional variations of the Scapa structures by regulating the amount of foam applied to various regions of the sheet to yield a heterogeneous basis weight distribution to provide regions of varying foam height. Another method is carving or further shaping an existing composite fabric before or after hardening of the foam. For example, the foam structures can be modified by pressing against another textured surface before full hardening, or by selective abrasion, sanding, laser drilling, or other forms of mechanical removal of the foam structure before or after hardening.

Several general methods can be applied to create three-dimensional nonwoven structures. If the nonwoven is attached to an underlying woven fabric, the three-dimensional shaping of the nonwoven or nonwoven layers may be done before or after attachment to the woven fabric. In particular, the nonwoven can be given a three-dimensional structure by establishment of a heterogeneous basis weight distribution during forming or by post-processing which adds or removes material at desired locations. When additional material is added to a nonwoven layer, such as a relatively uniform or planar layer, to thereby create a three-dimensional surface, the added material may be of a composition or nature other than that used to create the underlying nonwoven layer. Such composite three-dimensional nonwovens are within the scope of the present invention. For example, such a composite can comprise a first layer of a synthetic nonwoven fibrous mat in contact with an underlying woven base fabric, with a second nonwoven layer such as a polyurethane foam or reticulated foam added to the exposed surface of selected regions of said first nonwoven layer. The resulting composite can have heterogeneous basis weight, density, and chemical composition.

The contoured nonwoven substrate should present a paper-contacting surface having a plurality of elevations relative to a plane that is parallel to the plane of the fabric and tangent to the highest repeating element of the nonwoven substrate. Preferably, the structure comprises a repeating unit cell pattern. The highest repeating element, which should be the highest element of a repeating unit cell if a repeating unit cell structure exists, should be higher than the lowest paper-contacting element by at least 0.3 mm, desirably at least 0.5 mm, preferably at least 0.8 mm, more preferably at least 1.0 mm, still more preferably at least 1.2 mm, most preferably at least 1.5 mm, and preferably between 0.5 and 1.2 mm. Preferably, the lowest paper-contacting element of the wet-molding substrate is a nonwoven material. Obviously, holes and apertures of various sizes can be provided in the nonwoven layer, but if they are used, the air pressure differential during wet molding and drying should be low enough to prevent puncturing of the web over the apertures.

The contoured, non-planar nonwoven surface above the underlying porous member preferably should offer a machine-direction dominant structure having elevated elements running preferentially in the machine direction to provide a corrugated-like cross-sectional profile along selected paths in the cross-direction in order to increase the cross-directional (CD) stretch of the web. For example, if the profile shown in FIG. 1 were a CD profile and this shape were extruded in the machine direction, the resulting structure would be MD-dominant and would have high vertical variability in the cross-direction. In an MD-dominant structure, CD profiles will typically have a greater path length than MD profiles for profiles of a given absolute length (lateral distance between endpoints). MD dominant structures are important in providing high CD stretch to uncreped tissue products, a property important for softness and mechanical and tactile performance of the tissue.

The nonwoven surface can be structured to provide pillow-like contours rather than the sharp, precipitous peaks and valleys that are typical of 3-D woven structures, for such precipitous structures often give rise to grittiness in the final product. To achieve a pillow-like structure, the paper-contacting substrate should avoid sudden, precipitous peaks or valleys. In other words, surface profiles of the substrate should lack precipitous features.

Figure 2:
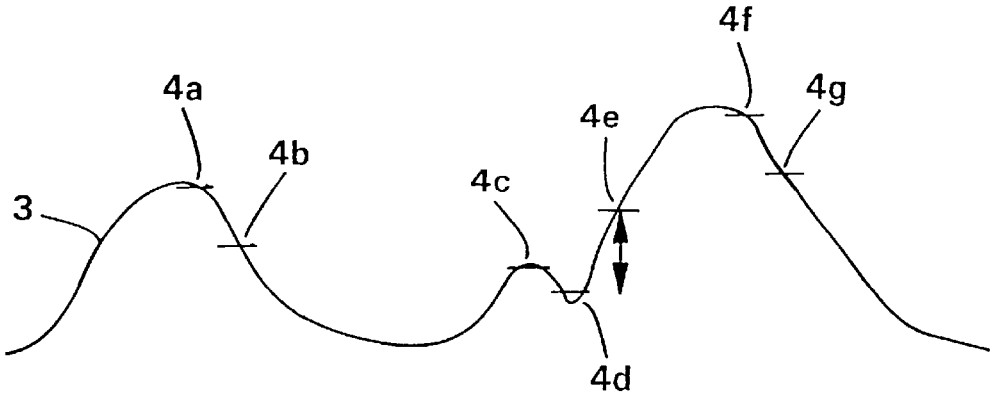
FIG. 2 is a depicts a region of a hypothetical profile of the upper surface of a wet molding substrate, comparing heights of various averaged elements along the profile for detection of precipitous regions.

Precipitous features can be described with reference to FIG. 2, where a portion of a height profile 3 from an hypothetical nonwoven surface is represented. Several segments of fixed length (100 microns, for example) are depicted as flat lines at a height corresponding to the average height of the profile segment spanned by the flat line segment. Segment 4*a,* for example, is at the average elevation of the upper portion of a peak on the left hand side of profile 3. Segment 4*b* begins immediately after segment 4*a* and represents the average height along the profile segment spanned by segment 4*b.* The difference in height between segments 4*a* and 4*b* is termed "nonprecipitous at a threshold of 0.5 mm" if the height difference is below 0.5 mm. FIG. 2 shows additional sample segments for detection of precipitous height changes. Segment 4*d,* corresponding to a valley, is compared to adjacent segments 4*c* and 4*e,* and segment 4*f* on a peak is compared to adjacent segment 4*g.* If all average height segments of the specified lateral length are within the specified height threshold of the immediately adjacent average height segments, then the profile is nonprecipitous at the specified threshold. A useful measure of precipitousness is found using a threshold of 0.5 mm and a line segment length of 300 microns. In terms of height profiles along arbitrary straight paths of the substrate, a precipitous feature occurs when an elevated element having a width of at least 300 microns has an average height more than 0.5 mm greater than the average height of any immediately adjoining segment of 300 microns in width, or where any depressed element having a width of at least 300 microns has an average height more than 0.5 mm less than the average height of any immediately adjoining segment of 300 microns in width. Alternatively, a more rigorous standard can use a threshold of 0.5 mm and a segment length of 100 microns, so a surface substantially free of precipitous elements can be alternatively defined by comparing heights of adjacent 100 micron segments of a profile rather than the 300 micron segments described above.

A substantially three-dimensional structure can also be imparted to an otherwise planar material by creating holes or slits by mechanical punching, cutting, stamping, drilling or the like. Further, the three-dimensional structure is created by altering the density of the nonwoven layer to create thick and thin regions to impart texture and bulk to the sheet molded thereon. Additionally, combinations of heterogeneous basis weight and heterogeneous density may be used to create a suitable three-dimensional nonwoven layer.

In describing the nonplanar, contoured nature of the surfaces useful in the present invention, the topography of the upper, paper-contacting elements in the nonwoven member must be considered. A paper contacting element of the nonwoven member is defined as any component of the nonwoven member that is visible when viewed from directly overhead the paper-contacting side of the substrate. Interstices passing through the nonwoven member are not paper contacting elements, but the uppermost solid member of the nonwoven member at any point is the paper contacting element. The paper-contacting elements should provide considerable variation in surface height in order to achieve desirable three-dimensional, wet-molded structures capable of developing high CD-stretch into a sheet formed thereon.

A measure of the nonplanarity of the paper-contacting elements can be obtained by measuring the Upper Surface Depth. To measure Upper Surface Depth, a line with a straight path length of 30 mm is drawn or represented on the upper surface of the substrate and a height profile is obtained along that line using moiré interferometry, stylus profilometry, or other methods known in the art. The height profile is fit to a least squares line, and the computed least-squares fit line is subtracted from the profile to remove any overall tilt from the profile. Ignoring individual fibers or elements less than about 100 microns in diameter in the least-squares adjusted profile, the Upper Surface Depth is the maximum peak to valley height difference of paper-contacting elements in the upper nonwoven member's least-squares adjusted profile. Nonplanar nonwoven member structures should have an Upper Surface Depth of at least 0.1 mm, preferably at least 0.5 mm, more preferably at least 1.0 mm, more preferably still at least 1.5 mm, and most preferably between 0.8 and 2.0 mm.

A preferred method for measuring surface profiles noninvasively is a CADEYES® 38-mm field-of-view moiré interferometry system by Medar, Inc. (Farmington Hills, Mich.). The CADEYES® system uses white light which is projected through a diffraction grid to project fine black lines onto the sample surface. The surface is viewed through a similar diffraction grid, creating moiré fringes that are viewed by a CCD camera. Suitable lenses and a stepper motor adjust the optical configuration for field shifting (a technique described below). A video processor sends captured fringe images to a PC computer for processing, allowing details of surface height to be back-calculated from the fringe patterns viewed by the video camera.

In the CADEYES moiré interferometry system, each pixel in the CCD video image is said to belong to a moiré fringe that is associated with a particular height range. The method of field-shifting, as described by Bieman et al. (L. Bieman, K. Harding, and A. Boehnlein, "Absolute Measurement Using Field-Shifted Moiré," SPIE Optical Conference Proceedings, Vol. 1614, pp. 259–264, 1991) and as originally patented by Boehnlein (U.S. Pat. No. 5,069,548, herein incorporated by reference), is used to identify the fringe number for each point in the video image (indicating which fringe a point belongs to). The fringe number is needed to determine the absolute height at the measurement point relative to a reference plane. A field-shifting technique (sometimes termed phase-shifting in the art) is also used for sub-fringe analysis (accurate determination of the height of the measurement point within the height range occupied by its fringe). These field-shifting methods coupled with a camera-based interferometry approach allows accurate and rapid absolute height measurement, permitting measurement to be made in spite of possible height discontinuities in the surface. The technique allows absolute height of each of the roughly 250,000 discrete points (pixels) on the sample surface to be obtained, if suitable optics, video hardware, data acquisition equipment, and software are used that incorporates the principles of moiré interferometry with field-shifting. Each point measured has a resolution of approximately 1.5 microns in its height measurement.

The computerized interferometer system is used to acquire topographical data and then to generate a grayscale image of the topographical data, said image to be hereinafter called "the height map." The height map is displayed on a computer monitor, typically in 256 shades of gray and is quantitatively based on the topographical data obtained for the sample being measured. The resulting height map for the 38-mm square measurement area should contain approximately 250,000 data points corresponding to approximately 500 pixels in both the horizontal and vertical directions of the displayed height map. The pixel dimensions of the height map are based on a 512×512 CCD camera which provides images of moiré patterns on the sample which can be analyzed by computer software. Each pixel in the height map represents a height measurement at the corresponding x- and y-location on the sample. In the recommended system, each pixel has a width of approximately 70 microns, i.e. represents a region on the sample surface about 70 microns long in both orthogonal in-plane directions). This level of resolution prevents single fibers projecting above the surface from having a significant effect on the surface height measurement. The z-direction height measurement must have a nominal accuracy of less than 2 microns and a z-direction range of at least 1.5 mm. (For further background on the measurement method, see the CADEYES Product Guide, Medar, Inc., Farmington Hills, Mich., 1994, or other CADEYES manuals and publications of Medar, Inc.)

The CADEYES system can measure up to 8 moiré fringes, with each fringe being divided into 256 depth counts (sub-fringe height increments, the smallest resolvable height difference). There will be 2048 height counts over the measurement range. This determines the total z-direction range, which is approximately 3 mm in the 38-mm field-of-view instrument. If the height variation in the field of view covers more than eight fringes, a wrap-around effect occurs, in which the ninth fringe is labeled as if it were the first fringe and the tenth fringe is labeled as the second, etc. In other words, the measured height will be shifted by 2048 depth counts. Accurate measurement is limited to the main field of 8 fringes.

The moiré interferometer system, once installed and factory calibrated to provide the accuracy and z-direction range stated above, can provide accurate topographical data for materials such as paper towels. (Those skilled in the art may confirm the accuracy of factory calibration by performing measurements on surfaces with known dimensions.) Tests are performed in a room under Tappi conditions (73° F., 50% relative humidity). The sample must be placed flat on a surface lying aligned or nearly aligned with the measurement plane of the instrument and should be at such a height that both the lowest and highest regions of interest are within the measurement region of the instrument.

Once properly placed, data acquisition is initiated using Medar's PC software and a height map of 250,000 data points is acquired and displayed, typically within 30 seconds from the time data acquisition was initiated. (Using the CADEYES® system, the "contrast threshold level" for noise rejection is set to 1, providing some noise rejection without excessive rejection of data points.) Data reduction and display are achieved using CADEYES® software for PCs, which incorporates a customizable interface based on Microsoft Visual Basic Professional for Windows (version 3.0). The Visual Basic interface allows users to add custom analysis tools.

Those skilled in the art can then examine profile lines along the topographical height map to determine characteristic Upper Surface Depth values of the structure. Lines of about 30 mm length can be manually or automatically drawn on the height map to select topographical data corresponding to the selected lines. The profile data are then extracted, subjected to a least-squares fit to ensure the line is flat (the squares fit is subtracted from the profile data), and the maximum peak-to-valley height difference is then determined, excluding lone structures less than about 100 microns in diameter that might correspond to lose fibers or pinholes. The objective is to estimate the characteristic depth of the surface that will determine the topography of the paper.

EXAMPLES

Example 1

A dilute aqueous slurry at approximately 1% consistency was prepared from 100% spruce bleached chemithermomechanical pulp (BCTMP). The spruce BCTMP is commercially available as Tembec 525/80, produced by Tembec Corp. of Temiscaming, Quebec, Canada. Kymene 557LX wet strength agent, manufactured by Hercules, Inc., Wilmington, Del., was added to the aqueous slurry at a dosage of about 20 pounds of Kymene per ton (10 kg/MT) of dry fiber. The slurry was then deposited on a forming fabric and dewatered by vacuum boxes to form a web with a consistency of about 12%. The web was then transferred to a transfer fabric using a vacuum shoe at a first transfer point. The fabric was further transferred from the transfer fabric to a woven through-drying fabric at a second transfer point using a second vacuum shoe. The through drying fabric used was a Lindsay Wire T-116-3 design (Lindsay Wire Division, Appleton Mills, Appleton, Wis.), based on the teachings of U.S. Pat. No. 5,429,686 issued to Chiu et al. At the second transfer point, the through-drying fabric was traveling more slowly than the transfer fabric, with a velocity differential between 2.8 and 10%. The web was then passed over a hooded through-dryer where the sheet was dried. The dried sheet was then reeled. The pilot paper machine for producing the uncreped paper was operated at a low speed of approximately 30 feet per minute to facilitate the demonstration of the invention described immediately hereafter. The basis weight of the dry sheet was approximately 39 gsm (grams per square meter).

To demonstrate the use of a nonwoven structure for wet molding of a paper web, a section of mostly polyolefin bonded carded web was obtained from a roll of 4-inch wide, 45 gsm material produced by Kimberly-Clark Corporation. This material was a blend of sheath-core polyethylene and propylene, with polyethylene on the outer surface of the fiber, and about 40% polyester fibers. The thickness of the material was about 1.7 mm when measured with a platen-based thickness gauge at a load of 0.05 psi and 1.04 mm at a load of 0.2 psi measured with a similar 3-inch diameter platen, resulting a Low Pressure Compressive Compliance of 0.39. The bonded carded web material was cut to a length of about 20 inches. The structure was shaped by simply punching a staggered grid of 0.25-inch holes across a region of the 20-inch strip, each hole spaced about 0.5-inches away (center point to center point) from its nearest neighbors in the array. After punching and after use in papermaking according to the present invention, the thickness of the punched region was measured at 1.28 mm at a load of 0.05 psi and 0.73 mm at a load of 0.2 psi, again with a three-inch diameter brass platen. To mold a portion of the web against the bonded-carded web section, the bonded-carded web was manually placed onto the through-drying fabric just before the second transfer point, such that the nonwoven material was carried into the transfer point to serve as a textured substrate onto which the corresponding section of the moist web was transferred. Vacuum suction at the transfer point and suction in the through-dryer roll served to deform the web onto the nonwoven surface. Following drying, the nonwoven material remained attached to the paper following separation of the sheet from the through-drying fabric. The nonwoven material was then manually removed from the paper prior to reeling. During through drying, vacuum suction pulled the web into the holes of the nonwoven material deep enough to impart the wire pattern onto the web overlying the holes, while the rest of the sheet overlying the nonwoven material remained relatively smooth. Since polyolefins were part of the polymer mixture, lower than normal dryer hood temperatures were required to eliminate the risk of melting. Thus, the hood temperature was kept near 200° F. for the demonstration runs. The slower dryer rate in turn called for reduced speed (ca. 30 feet/min) to obtain a reasonably dry sheet. In many cases the portion of the sheet molded against a nonwoven material was more moist than surrounded areas and had shrunk less during through drying, resulting in some macroscopic wrinkling due to the nonuniformity of drying and shrinkage. This problem could be eliminated by using a continuous loop of the nonwoven material to provide more uniform drying conditions. Preferably, the nonwoven is of a temperature-resistant polymer such as polyester or any other polymer known in the art of dryer fabrics, selected to enable higher dryer temperatures.

Figure 3:
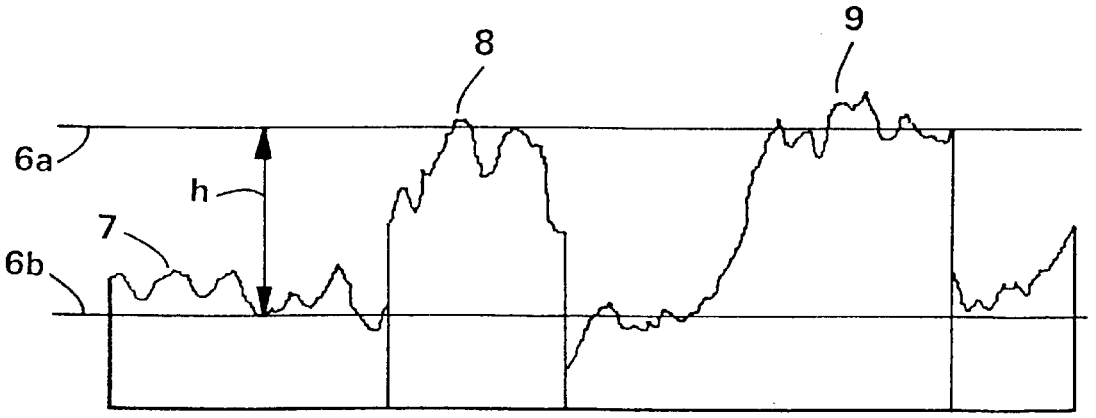
FIG. 3 is a measured height profile from the surface of the paper produced in Example 1.

Two levels of rush transfer at the second transfer point were examined, namely, 2.8% and 10%, while maintaining approximately 0% rush transfer at the first transfer point. After reeling the paper and storing the reel at recommended TAPPI conditions for over 5 days, the textured segments of the web were examined. It was observed that rush transfer assisted molding of the web onto the nonwoven surface, with 10% rush transfer yielding better visibility and differentiation of the nonwoven pattern than low differential velocity offers. Of the two levels examined, 10% rush transfer proved to be more useful in achieving good definition and clarity of the surface pattern, though rush transfer does not appear necessary for successful results. FIG. 3 depicts a surface profile 7 from a portion of sample made according to Example 1 at a rush transfer level of 10%. The measured portion had been in contact with the nonwoven material during through drying, and two elevated regions are visible showing the impressions made by suction over two of the punched holes. A vertical distance h of 0.57 mm exists between the two parallel, horizontal lines 6*a* and 6*b,* which correspond to the 10% and 90% material surface lines (10% of the profile is above line 6*a* and 90% is above line 6*b*). The vertical rise of over 0.5 mm is indicative of the significant three-dimensional structure which can be imparted by the present invention. The fine structure seen in the elevated regions (marked by 8 and 9, respectively) is largely due to the structure of the underlying through-drying web, which imparted additional texture to the regions impressed into the holes of the nonwoven material, and which imparted a small amount of texture to regions elsewhere on the nonwoven material as it was conformed in part to the through-drying fabric structure. Use of a nonwoven with high resiliency could prevent any of the underlying fabric structure from "showing through" the nonwoven, if desired.

The thickness of the region that was molded against the punched nonwoven was 0.89 mm, measured with a solid 3-inch diameter platen loaded at 0.05 psi and a Mitutoyo thickness gauge. A thickness of 0.89 mm for a 39 gsm sheet corresponds to a bulk of 22.9 cc/g, an exceptionally high value for tissue. The surrounding paper regions molded onto the underlying Lindsay Wire T-116-3 through drying fabric, a highly textured fabric, had a thickness of about 0.73 mm and a bulk value of 18.7 cc/g. For samples produced with a rush transfer of 2.8%, the gain in sheet thickness was less. The region molded against the punched nonwoven had a thickness of about 0.73 mm, compared to 0.64 mm for the surrounding paper that had only been in contact with the through-drying fabric.

Example 2

The same procedures and equipment were used as in Example 1, except that the nonwoven material was a commercial ScotchBrite™ cleaning pad (Type A, "very fine") manufactured by 3M Company, St. Paul, Minn. Measured with a platen thickness gauge at 0.05 psi, the pad thickness is 9.7 mm. However, the pad was manually peeled to reduce its thickness to a value of about 4 mm to improve runnability when inserted in the pilot paper machine. Multiple holes of ⅜-inch diameter were punched onto the ScotchBrite pad. The pad was applied to the second transfer area as described above. The pad proved to still be excessively thick, resulting in some tearing of the wet paper around the edges of the pad and over the holes.

Example 3

The same procedures and equipment were used as in Example 1, except that the nonwoven material was a two-layer bonded carded web material having a total thickness of about 4.8 mm at 0.05 psi and 3.0 mm at 0.2 psi platen loads. The upper half of the nonwoven was cut to provide it with slits about 0.2 inches wide and 3 inches long. Paper formed on the slitted nonwoven carried thin, raised elongated markings corresponding to the slitted regions of the substrate. The decreased amount of air flow through the nonwoven, due to the thickness of the lower layer of nonwoven, resulted in less definition of the markings in the pattern.

It will be appreciated that the foregoing examples, given for purposes of illustration, are not to be construed as limiting the scope of this invention, which is defined by the following claims and all equivalents thereto.

We claim:

1. A method for making a high bulk paper sheet comprising the steps of:

(a) forming an embryonic web from an aqueous dispersion of papermaking fibers by depositing the papermaking fibers onto a papermaking forming fabric;

(b) transferring the web from the papermaking forming fabric to a gas-permeable wet molding substrate comprising an upper porous extruded member having regions of varying height and an underlying woven member attached to said upper extruded member, with the web residing on said upper porous extruded member;

(c) applying an air pressure differential across said web to further mold said web against said upper extruded member; and (d) noncompressively drying said web to a dryness level of at least about 50%.

2. The method of claim 1 wherein said upper extruded member comprises a layer of synthetic polymer material having a Low Pressure Compressive Compliance greater than 0.05, a High Pressure Compressive Compliance greater than 0.05, and an Upper Surface Depth of at least 0.1 mm.

3. The method of claim 1 wherein the velocity of said web is reduced during the transfer to said web molding substrate by at least 8% and the transfer to said wet molding substrate occurs at a solids level in said web of about 40% or less.

4. The method of claim 1 wherein the solids level of the web is about 30 percent or less during the transfer from the forming fabric to the wet molding substrate.

5. A method for making a high bulk paper sheet comprising the steps of:

(a) forming an embryonic web from an aqueous dispersion of papermaking fibers by depositing the papermaking fibers onto a papermaking forming fabric;

(b) transferring the web from the papermaking forming fabric to a gas-permeable wet molding substrate comprising an upper porous extruded member and an underlying woven member attached to said upper extruded member, with the web residing on said upper porous extruded member, wherein (1) said upper extruded member comprises a layer of synthetic polymer material having a Low Pressure Compressive Compliance greater than 0.05, a High Pressure Compressive Compliance greater than 0.05, an Upper Surface Depth of at least 0.1 mm;

(2) the velocity of said web is reduced during the transfer to said wet molding substrate by at least 8%; and (3) the transfer to said wet molding substrate occurs at a solids level in said web of about 40% or less;

(c) applying an air pressure differential across said web to further mold said web against said upper extruded member;

(d) noncompressively drying said web to a dryness level of at least about 50%.

6. The method of claim 5, wherein said upper porous extruded member of said wet molding substrate has an Upper Surface Depth of at least 0.5 mm.

7. The method of claim 5 wherein the surface of the upper porous extruded member lacks precipitous features as determined by a threshold height of 0.5 millimeters and a line segment width of 300 microns.

8. The method of claim 7 wherein the line segment width is 100 microns.

* * * * *